US005186836A

United States Patent [19]

Gauthier et al.

[11] Patent Number: 5,186,836

[45] Date of Patent: Feb. 16, 1993

[54] CO-CURRENT CYCLONE SEPARATOR AND ITS APPLICATIONS

[75] Inventors: Thierry Gauthier, Saint Genis Laval, France; Maurice Bergougnou; Cedric Briens, both of London, Canada; Pierre Galtier, Vienne Estressin, France

[73] Assignee: Institut Francais du Petrole, Rueil Malmaison, France

[21] Appl. No.: 710,047

[22] Filed: Jun. 4, 1991

[30] Foreign Application Priority Data

Jun. 5, 1990 [FR] France ..... 90 06938

[51] Int. Cl.[5] ..... B04C 1/00

[52] U.S. Cl. ..... 210/512.1; 210/787; 209/144; 209/211; 55/394; 55/396; 55/398; 55/457; 55/459.1

[58] Field of Search ..... 210/360.1, 512.1, 512.3, 210/787; 209/144, 211; 55/391, 392, 396, 397, 398, 399, 448, 394, 423, 449, 450, 451, 459.1, 426

[56] References Cited

U.S. PATENT DOCUMENTS

| | | | |
|---|---|---|---|
| 2,650,675 | 3/1950 | Yellot | 55/459.1 |
| 3,955,948 | 5/1976 | Campolong | 55/394 |
| 4,746,340 | 5/1988 | Durre et al. | 55/399 |
| 4,865,633 | 9/1989 | Stevenson | 55/459.1 |

*Primary Examiner*—Robert A. Dawson
*Assistant Examiner*—David Reifsnyder
*Attorney, Agent, or Firm*—Millen, White, Zelano and Branigan

[57] ABSTRACT

A co-current separator is provided which makes it possible to separate a light phase contained in a mixture from a dense phase. Disposed downstream in the direction of circulation of the dense phase is an internal output opening of an interior enclosure. Fins are provided on the interior enclosure for limiting the progression of the light phase to the outside of the interior enclosure. The mixture is introduced tangentially into an inlet, and the dense phase is recovered at one outlet with the light phase recovered at another outlet. This makes it possible to rapidly separate the dense phase from the light phase, providing an apparatus useful for separating, for example, a solid from a gas.

9 Claims, 4 Drawing Sheets

CO-CURRENT CYCLONE SEPARATOR AND ITS APPLICATIONS

CROSS-REFERENCE TO RELATED APPLICATIONS

The present invention relates to copending U.S. patent application Ser. No. 710,048, filed Jun. 4, 1991 now U.S. Pat. No. 5,129,930.

BACKGROUND OF THE INVENTION

The present invention relates to a co-current cyclone separator. This equipment, used in chemical engineering, is an apparatus which makes it possible to separate a dense phase D1 contained in a mixture M1 containing the said dense phase D1 and a light phase L1.

The present invention likewise relates to the use of this improved cyclone separator for the rapid separation of a dense phase D1 and a dilute phase L1 from their mixture M1.

According to the prior art, several types of cyclone are already known the performance levels of which are usually evaluated on a basis of their efficiency in collecting the dense phase D1 and the loss of head of the light phase L1 in the cyclone separator (hereinafter referred to as the apparatus). In the vast majority of cases, apparatuses of this type are designed with an eye to achieving the greatest possible efficiency in collecting the dense phase D1 while limiting as far as possible the loss of head of the light phase L1.

A first type of cyclone is the reverse flow cyclone in which the mixture M1 containing the phases D1 and L1 tangentially enters the enclosure of the cyclone in the immediate vicinity of its top which, at least for the light phase L1, induces a vortex and the centrifugal force which is derived therefrom makes it possible for the dense phase D1 to migrate to the wall of the enclosure where it progresses in a spiral (following a helical movement) towards the bottom of the separator where it is normally collected or evacuated via a collector cone at the level of which the vortex of the light phase is reversed. The light phase L1 having changed direction emerges in counter-current from the dense phase D1 to the end of the separator where the intake of mixture M1 is located.

A second type of cyclone is the co-current cyclone in which the mixture M1 containing the phases D1 and L1 enters axially or tangentially. In the case of an axial intake, the vortex is normally initiated with the help of blades in the form of a helix. In this type of cyclone, the outlet of the light phase L1 and the outlet of the dense phase D1 are situated close to the same end of the cyclone which is the end opposite that through which the mixture M1 is introduced into the apparatus. Therefore, there will be an outlet referred to as an internal or interior outlet through which the light phase L1 is discharged and an outlet referred to as an external or exterior outlet through which the dense phase D1 is discharged.

For certain applications, such as for example in the case of the process referred to as ultrapyrolysis, described for example by Graham et al, World Fluidisation Conference, May 1986, Elsinore Denmark, which is a high temperature cracking process performed in a fluidised state and with gas dwell times in the reactor of less than one second, it is necessary to use a very high speed separator. In this process, the chemical reaction of thermal cracking is initiated by heat-bearing solids and occurs in a piston flow reactor. The reaction time is very short, usually about 100 to about 900 milliseconds (ms) and it is important, if the process is to be properly efficient thermally, very rapidly to separate the solids from the gases before carrying out any rapid hardening of the gaseous products. The dwell time in the separator should be as short as possible and furthermore the distribution of dwell times must be as narrow as possible in order to minimise secondary cracking reactions which might result in the deterioration of exploitable products.

By reason of its very principle, based on the turnround of the gaseous phase, it is scarcely possible to alter the geometry of a return flow cyclone in order to limit the dwell time of the light phase L1 in the apparatus. The length (Lc) of the apparatus is indeed imposed by the natural length of the vortex (Lv) as is for example described by R. M. Alexander in Fundamentals of cyclone design and operation, Proc. Aus. I.M.M., 1949, pages 203–228, or by S. Bryant et al, hydrocarbon processing, 1983, pages 87–90. This length (Lv) is usually around 3 to 4 times the diameter (Dc) of the apparatus. If the length of the apparatus is reduced then the vortex will bear on the outlet cone of the dense phase D1 causing a re-entrainment of the light phase by the dense phase circulating in a spiral towards its outlet. If one increases the speed of intake of the mixture M1, there is a simultaneous increase in erosion at the level of the tangential intake which is not industrially desirable.

In a co-current cyclone, the dense and light phases circulate in the same direction. The dense phase is drawn off through an external pipe and the light phase through an internal pipe, of which the entrance, referred to as the internal inlet, is situated at a distance (Ls) which may be much shorter than the length (Lc) of the reverse flow cyclone. This internal intake can be quite close to the intake of the mixture M1 but the closer it is the more the light phase will tend to circulate into the external outlet, around the internal pipe, before emerging again under the influence of the helical movement of the phases which make up the mixture. Furthermore, the closer the internal intake is to the intake for the mixture M1, the more collection of the dense phase D1 will be subject to the influence of turbulences existing at the level of the mixture intake. For example, in the case of a conventional 'flat roof' tangential intake, the flow of phases into the entrance is altered by interference and turbulence which throw part of the dense phase into the central part of the apparatus producing a reduction in efficiency of the collection of the dense phase D1 which will be all the more substantial the closer the internal intake of light phase L1 is to the tangential intake of the mixture M1.

In this type of co-current, in contrast to what happens with reverse flow cyclones, it is possible by placing the internal intake of the light phase fairly close to the intake of the mixture M1 (at a distance which is less than the length (Lc) of the reverse flow cyclone, and monitoring the circulation of the light phase in the internal intake and the flow in the intake of mixture M1, to obtain a rapid separation of the phases while retaining a satisfactory level of efficiency of collection of the dense phase D1 and while enjoying an acceptable distribution of dwell time of the light phase.

SUMMARY OF THE INVENTION

The present invention relates to a co-current cyclone separator which makes it possible very rapidly to separate a dense phase D1 and a light phase L1 from their mixture M1 with a very good level of efficiency of collection of the dense phase D1 and with a distribution of dwell times of the light phase L1 in the apparatus which is narrower than in prior art cyclones. The volume which can be used for separation can in the apparatus according to the invention be smaller than in the prior art cyclones and consequently separation at a constant rate of flow of light phase can be more rapid.

To be more precise, the present invention relates to a co-current cyclone separator which comprises in combination:

at least one outer enclosure which is elongate along one axis and which has a substantially circular cross-section of diameter (Dc) comprising at a first end introduction means which make it possible to introduce through an inlet referred to as the external inlet, a mixture M1 containing at least one dense phase D1 and one light phase L1, the said means being adapted to impart at least to the light phase L1 a helical movement at least in the direction of flow of the said mixture M1 into the said outer enclosure, likewise comprising means of separating phases D1 and L1 and at the opposite end to the first end mentioned recovery means which make it possible to recover via an outlet comprising a lateral or axial pipe and referred to as the external outlet, at least a part of the dense phase D1 and having a length L between the said opposite ends, at least one interior enclosure elongated along one axis, of substantially circular cross-section, disposed coaxially in relation to the said outer enclosure, comprising at a distance Ls which is less than L from the extreme level of the external inlet, an inlet referred to as an internal inlet of diameter (Di) which is less than (Dc) into which enters at least a part of the light phase L1 and at its opposite end recovery means making it possible to recover via a pipe referred to as the internal pipe, respectively axial if the pipe of the external outlet is lateral or lateral if the pipe of the external outlet is axial, the said part of the light phase L1, characterised in that it comprises on the downstream side in the direction of travel of the dense phase D1, from the level of the internal inlet of the internal enclosure, means limiting the progress of the light phase L1 to the outside of the said internal enclosure, the said means being substantially plane blades, the plane of which passes through a substantially vertical axis.

BRIEF DESCRIPTION OF THE DRAWINGS

The invention will be more clearly understood from the description of embodiments given purely by way of illustration and implying no limitation of any kind, and which will follow, and in which reference is made to the accompanying drawings in FIGS. 1A, 1B, 2, 3, 4 and 5 of which similar parts are designated by the same reference numbers and letters.

DETAILED DESCRIPTION

Figure 1A:
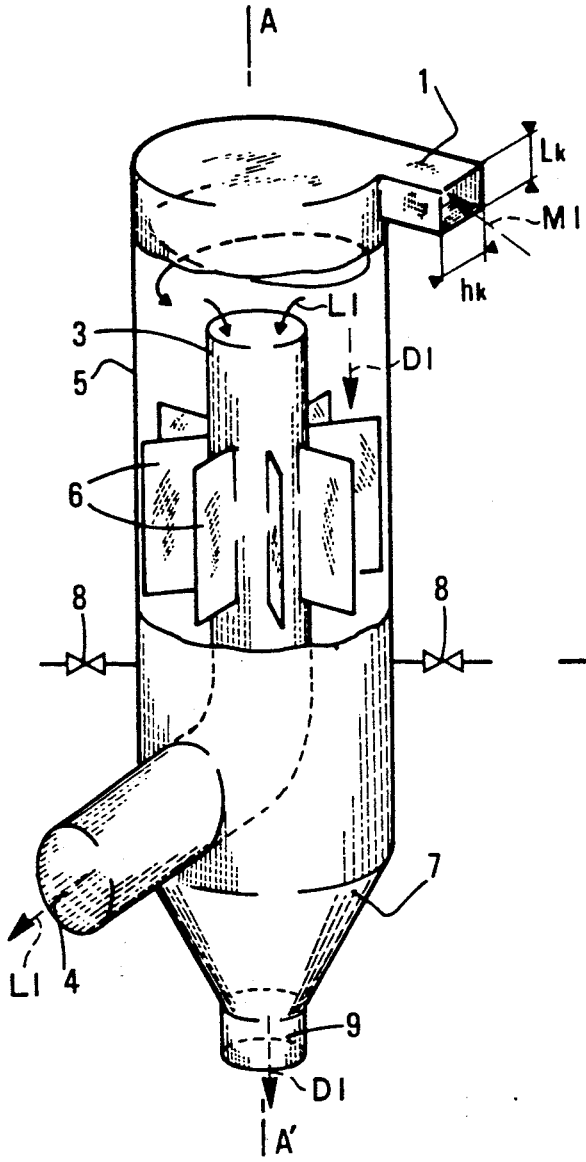
FIG. 1A is a perspective view, with portions cut away, of an apparatus according to a first embodiment of the invention.

FIG. 1A is a perspective view of an apparatus according to the invention.

Figure 1B:
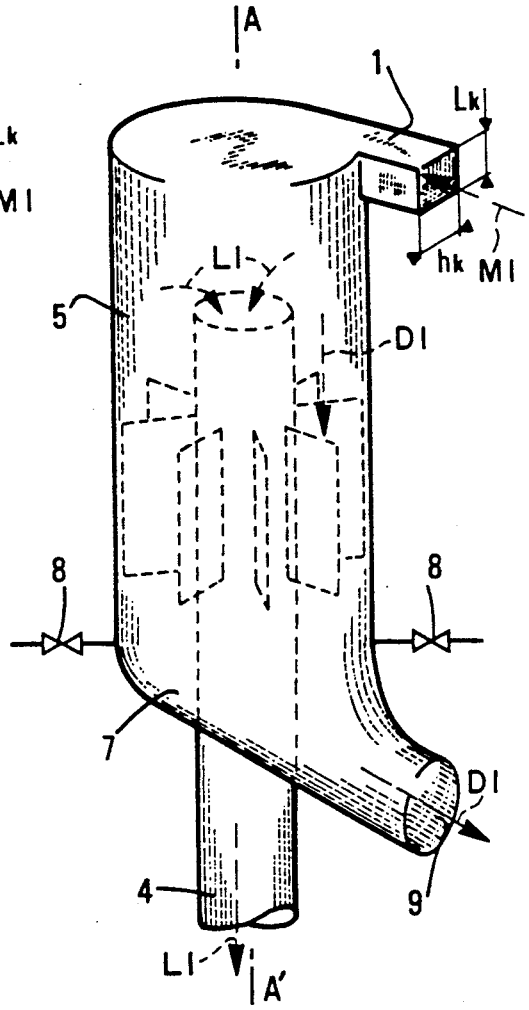
FIG. 1B is a perspective view, with portions in phantom, of a second embodiment of the invention.

FIG. 1B is a perspective view of an apparatus according to the invention which differs from that shown in FIG. 1A solely by the means of recovery of a dense phase D1 and of a light phase L1. In the case of the apparatus shown diagrammatically in FIG. 1A, the said means permit recovery of the dense phase D1 via an axial pipe and recovery of the light phase L1 by a lateral pipe while in the apparatus shown diagrammatically in FIG. 1B they permit recovery of the dense phase D1 via a lateral pipe and recovery of the light phase L1 via an axial pipe.

Figure 2:
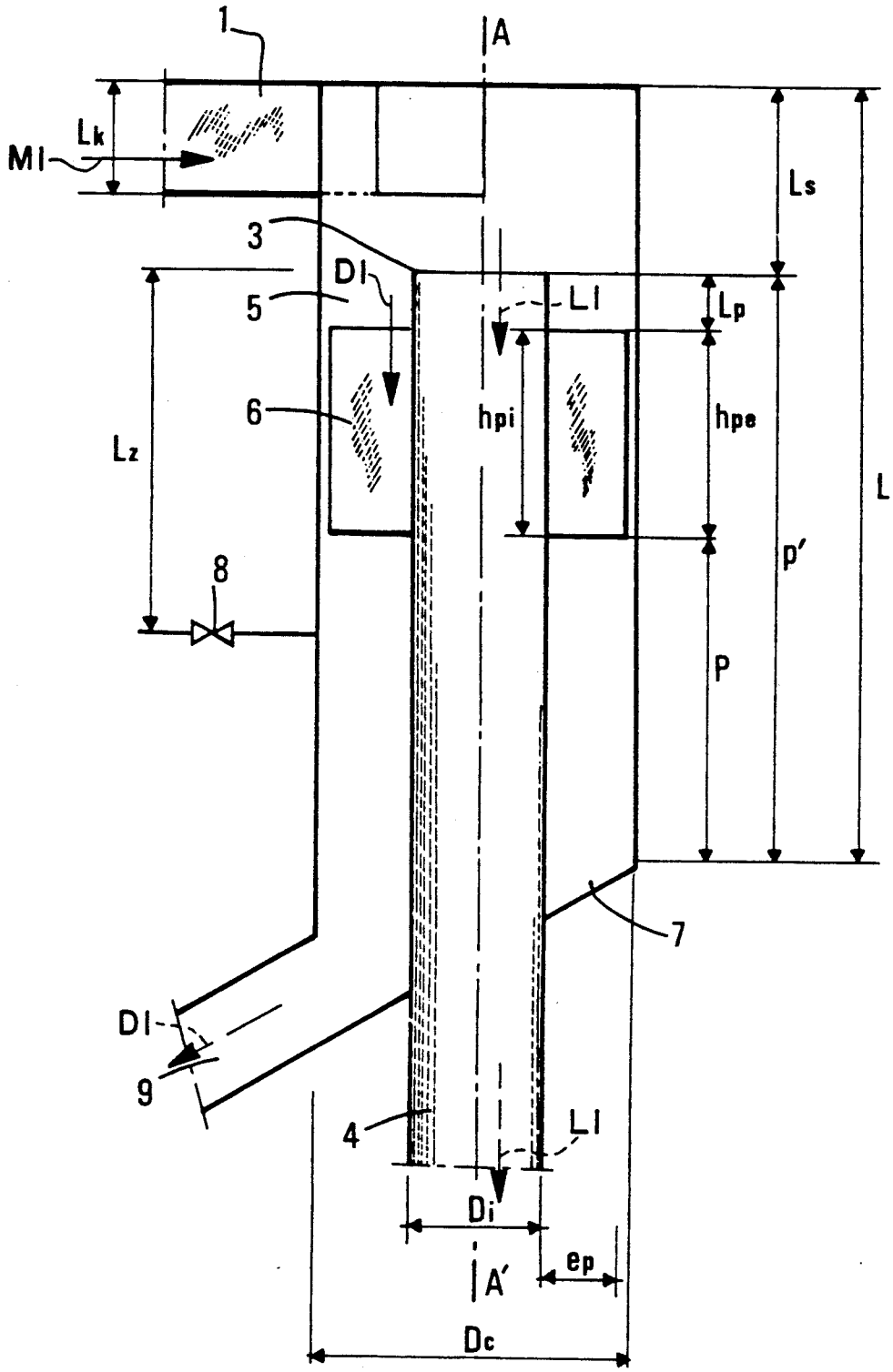
FIG. 2 is a side elevation of the second embodiment shown in FIG. 1B.

FIG. 2 is a cross-sectional view of an apparatus according to the invention which is virtually identical to that shown in FIG. 1B but which comprises fin blade means (6) limiting the progress of the light phase L1 to the exterior of the internal enclosure 3, the dimensions of which in the direction at right-angles to the axis of the external enclosure being less than the dimensions of the external outlet (5).

The apparatuses according to the invention which are shown diagrammatically in FIGS. 1B and 2 and which are of substantially regular and elongated form comprise an external enclosure having an axis AA' which is a substantially vertical axis of symmetry of diameter (Dc) and length (L) between the extreme level of the tangential inlet (1), referred to as the external inlet, and the means (7) by which the dense phase D1 emerges. The mixture M1 containing at least one dense phase D1 and at least one light phase L1 is introduced via the tangential inlet (1) according to a direction which is substantially at right-angles to the axis of the external enclosure. This tangential inlet preferably has a rectangular or square cross-section, of which the side parallel with the axis of the external enclosure has a dimension (Lk) which is usually approx. 0.25 to 1 times the diameter (Dc) while the side at right-angles to the axis of the external enclosure has a dimension (hk) which is usually approx. 0.05 to approx. 0.5 times the diameter (Dc).

These apparatuses comprise an internal enclosure which is elongated along an axis and which is of substantially vertical and circular cross-section, disposed coaxially in relation to the said external enclosure, comprising at a distance (Ls) which is less than (L) from the extreme level of the external inlet (1), an inlet (3) referred to as the internal inlet, of diameter (Di) which is less than (Dc). The diameter of this internal inlet (3) is normally approx. 0.2 to approx. 0.9 times the diameter (Dc), most frequently approx. 0.4 to approx. 0.8 times the diameter (Dc) and preferably approx. 0.4 to approx. 0.6 times the diameter (Dc). This distance (Ls) is usually approx. 0.2 to approx. 9.5 times the diameter (Dc) and is most frequently approx. 0.5 to approx. 2 times the diameter (Dc). A relatively short distance comprised between 0.5 and 2 times the diameter (Dc) normally permits of very rapid separation while preserving a good level of separation efficiency.

The apparatuses likewise comprise on the downstream in the direction of circulation of the dense phase D1 from the level of the internal inlet (3) blade means (6) which limit the progress of the light phase L1 into the space situated between the interior wall of the external enclosure and the external wall of the interior enclosure or external outlet (5). Said blade means (6) are usually positioned on the inside of the external enclosure and outside the internal enclosure (between the outer wall of the inner enclosure and the inner wall of the outer enclosure), between the level of the internal inlet (3) and the funnel means (7) of recovering the dense phase D1. The funnel means (7) provides a surface extending transverse to the axis (A) of the outer enclosure which intercepts the dense phase D1 and directs the dense phase to the outer enclosure outlet (9). Said blade means (6) are preferably substantially plane blades, the plane of which passes through a substantially vertical axis and they are usually fixed on at least one wall of the one of the enclosure, the inner or outer enclosure. These means are preferably fixed to the wall of the inner enclosure so that the distance (Lp) between the internal inlet and the point on the said blades which come closest to this internal inlet is approx. 0 to approx. 5 times the diameter (Dc) and preferably approx. 0.1 to approx. 1 times this diameter (Dc).

The number of blades will vary according to the distribution of the dwell time which is accepted for the phase L1 and likewise according to the diameter (Dc) of the outer enclosure. The number of blades is usually at least two and is for example from 2 to 50 and is more often than not from 3 to 50. The blades allow a limitation of the continuation of the vortex over the entire cross-section of the cyclone in the outer outlet (5) around the pipe which forms the inner enclosure and connecting the inner inlet (3) to the inner outlet (4) of the light phase and therefore a diminution in and monitoring of the distribution of the dwell times of this phase in the apparatus.

Thus, if the apparatus according to the invention is being used in the performance of ultra high speed reactions, for example in the case of ultrapyrolysis, the dwell time of the light phase L1 is limited along with the distribution of these dwell times and consequently the deterioration of the products contained in the light phase circulating around the internal inlet is also limited.

Each of these blades normally has a dimension or width (ep) measured in the direction at right-angles to the axis of the inner enclosure (that is to say horizontally) from its edge which is closest to the axis of the outer enclosure, and defined in relation to the inside diameter (Dc) of the outer enclosure and to the outer diameter (D'e) of the inner enclosure of approx. 0.01 to 1 times the value [((Dc)−(D'e))/2] of half the difference of these diameters (Dc) and (D'e), preferably of approx. 0.5 to approx. 1 times its value and more often than not approx. 0.9 to approx. 1 times this value.

In the case of a vertical apparatus according to the invention such as is for example shown diagrammatically in FIG. 1A, having a lateral inner outlet (4) and, when the blades are positioned before this inner outlet, this dimension (ep) may be approx. 0.01 to approx. 1 times the value (Dc)/2 of the half-diameter of the outer enclosure.

Each of the blades has on its edge closest to the axis of the inner enclosure, in the direction parallel with the substantially vertical axis through which the plane of the blade passes, an inner dimension or height (hpi) and an outer dimension or height (hpe) measured in the direction parallel with the substantially vertical axis through which the plane of the blade passes, on the edge of the said blade which is closest to the inner wall of the outer enclosure. These dimensions (hpe) and (hpe) are usually greater than 0.1 times the diameter (Dc) and for example approx. 0.1 times to approx. 10 times the diameter (Dc) and most frequently approx. 1 to approx. 4 times this diameter (Dc). Preferably, each of these blades has a dimension (hpe) greater than or equal to their dimension (hpe).

According to the embodiment shown diagrammatically in FIGS. 1B and 2 the apparatus comprises on the downstream side in the direction of flow of the various phases, from the inner inlet (3) at least one means (8) permitting possible introduction of a light phase L2 at least at a point situated between the inner inlet (3) of the inner enclosure and the end of the pipe (9) for recovering the dense phase D1; this point or these points is/are preferably at a distance (Lz) from the inlet (3) of the inner enclosure. The said distance (Lz) is preferably at least equal in value to the sum of the values of (Lp) and (hpe) and is at most equal to the distance between the inlet (3) of the inner enclosure and the outlet funnel means (7) provided for the dense phase D1. This light phase L2 may be introduced for example in the event of its being desirable to perform a stripping of the dense phase D1.

This light phase L2 is preferably introduced at several points which are usually symmetrically distributed in a plane at the level of which introduction is performed and around the outer enclosure.

The point of introduction of this light phase L2 is usually at a distance which is at least equal to 0.1 times the diameter (Dc) from that point within the blade means (6) which is closest to the outlet funnel means (7) provided for emergence of the dense phase D1. The point of introduction of this light phase L2 is preferably situated close to the pipe (9) for the recovery of the dense phase D1 and is more often than not close to the means (7) for discharging the dense phase D1.

The dimension (p') between the level of the inner inlet (3) and the funnel means (7) of discharging the dense phase D1 is determined on a basis of the other dimensions of the various means which constitute the apparatus and the length (L) of the outer enclosure measured between the extreme level of the tangential inlet (1) and the funnel means (7) through which the dense phase D1 emerges. This dimension (L) is usually about 1 to about 35 times the diameter (Dc) of the outer enclosure and is more often than not approx 1 to 25 times this diameter (Dc). It is possible in the same way to calculate the dimension (P) between that point of the means (6) which is closest to the funnel means (7) through which the dense phase D1 emerges and the said funnel means (7) on a basis of the other dimensions of the various means forming the apparatus and the length (L).

The blade means (6) limits the progression of the vortex of the light phase L1 into the outer outlet (5). The position of these blade means (6) and their number therefore affect the performance of separation of the phases D1 and L1 contained in the mixture M1 (loss of head and efficiency of collection of the phases) and also penetration of the vortex of the light phase L1 into the outlet (5). These parameters will therefore be chosen carefully by a man skilled in the art, particularly a function of the desired results and the loss of head which is tolerated. In particular when D1 is a solid the number of blades their form and their position will be chosen carefully taking into account their influence on the flow of the solid in conjunction with the desired limitation of the progression of the vortex into the outer outlet (5).

Figure 3:
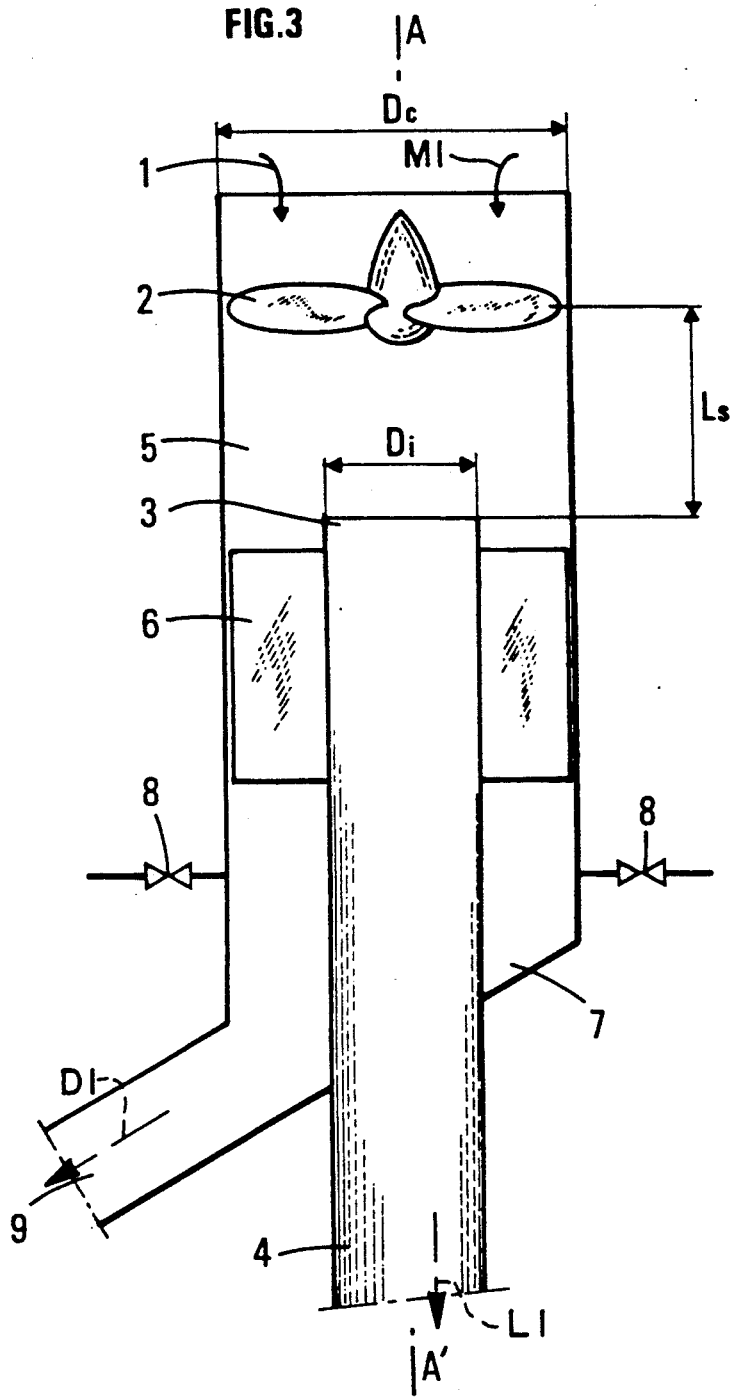
FIG. 3 is a side elevation of a third embodiment of apparatus according to the invention.

FIG. 3 is a perspective view of an apparatus according to the invention comprising an outer enclosure of diameter (Dc) having an inlet (1) referred to as the axial outer inlet, into which is introduced in a direction substantially parallel with the axis (AA') of the outer enclosure the mixture M1 containing a dense phase D1 and a light phase L1. This apparatus furthermore comprises means (2) disposed inside the inlet (1) and making it possible to impart downstream in the direction of circulation of the said mixture M1 a helical or turbulent movement at least to the phase L1 of the said mixture M1. These means are usually inclined blades. The length (L) of the apparatus is counted between these means making it possible to create a vortex, at least on the phase L1, and funnel means (7) through which the dense phase D1 emerges. All the other characteristic features are identical to those described in connection with the apparatuses shown in FIGS. 1A and 2, particularly the various dimensions are those mentioned in the description of these apparatuses. The alternatives described in connection with these apparatuses shown in FIGS. 1A and 2 are likewise possible in the case of the apparatus according to the present invention, shown diagrammatically in FIG. 3. It is in particular possible to envisage a lateral inner outlet (4) and an axial pipe (9) for the recovery of the dense phase D1 as in the case of the embodiment shown diagrammatically in FIG. 1B.

Figure 4:
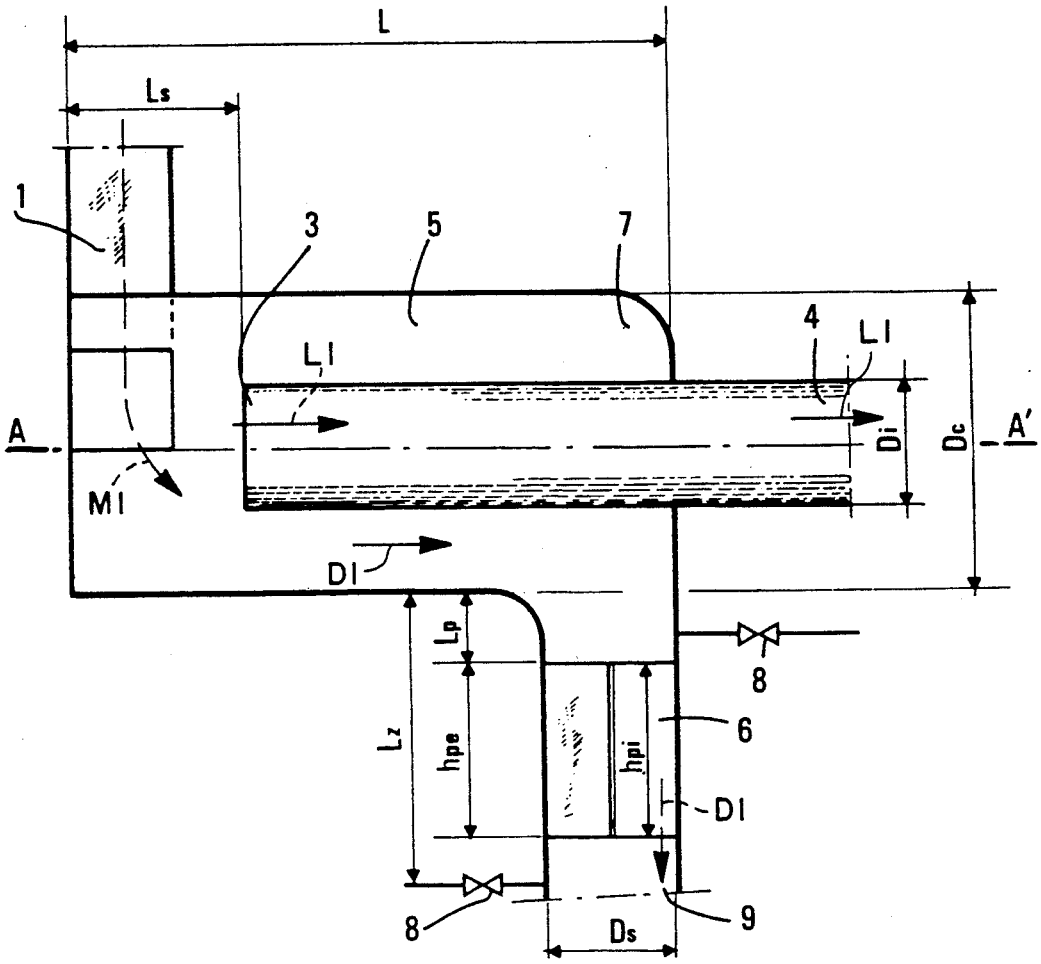
FIG. 4 is a side elevation of a fourth embodiment of apparatus according to the invention.

FIG. 4 is a cross-sectional view of an apparatus according to the invention, of elongated substantially regular form comprising an outer enclosure having an axis (AA') which is an axis of symmetry which is substantially horizontal and of diameter (Dc) and of length (L) between the extreme level of the tangential inlet (1) referred to as the outer inlet, and the means (7) through which the dense phase D1 emerges. The mixture M1 containing at least one dense phase D1 and at least one light phase L1 is introduced through the tangential inlet (1) in a direction substantially at right-angles to the axis of the outer enclosure.

This apparatus likewise comprises on the downstream side in the direction of circulation of the dense phase D1, from the level of the inner inlet (3), means (6) which limit the progression of the light phase L1 to the outside of the inner enclosure into the space situated between the inner wall of the outer enclosure and the end wall of the inner enclosure or outer outlet (5). Said blade means (6) are normally positioned on the downstream side in the direction of travel of the dense phase D1, means of recovering (7) the dense phase D1 in the pipe (9) for recovering the dense phase D1, of diameter (Ds).

These blade means (6) are usually substantially flat blades the plane of which passes through a substantially vertical axis. The dimension (ep) of each of these blades is usually approx. 0.01 to approx. 1 times the diameter (Ds) of the pipe (9). Usually, the blades are so positioned that the inner edge, that is to say the edge of the blade which is closest to the axis of the pipe (9), of each of them is coincident with the axis of the said pipe (9). These blades are positioned at a distance (Lp) in relation to the funnel means (7) of approx. 0 to approx. 5x(Dc).

The means (8) which make it possible perhaps to introduce a light phase L2 are normally positioned downstream in the direction of travel of the dense phase D1 of the level of the inner inlet (3) and preferably between the funnel means (7) of recovering the dense phase D1 and the end of the pipe (9) for recovering the dense phase D1. In the case of the apparatus shown diagrammatically in FIG. 4, introduction of a light phase L2 is provided for at 2 different levels via a first means (8) at the level of the funnel means (7) and via a second means (8) below the means (6). The means (8) are positioned at a distance (Lz) from the means of recovery of the dense phase D1 measured from the said funnel means (7).

This apparatus shown diagrammatically in FIG. 4 comprises a pipe (9) for recovering the dense phase D1 and of diameter (Ds) normally equal to approx. 0.1 to approx. 1 times the diameter (Dc) and more often than not of approx. 0.2 to approx. 0.7 times this diameter.

All the other characteristic features of this horizontal cyclone separator are identical to those described in connection with the apparatuses shown in FIGS. 1A and 2, particularly the various dimensions are those mentioned in the description of these apparatuses.

Figure 5:
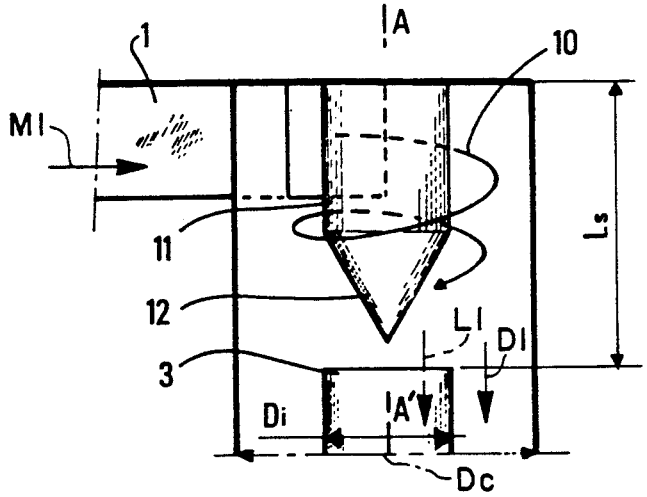
FIG. 5 is a side elevation of a portion of apparatus comprising a fifth embodiment of the invention.

Although not shown in FIGS. 1A, 1B, 2, 3 and 4 it is possible and usually desirable in the case of considerably rates of flow of the various phases at the level of the apparatus inlets to use means which make it possible to encourage the formation of the vortex. Such means (10) are for example shown in FIG. 5 which represents in a preferred embodiment of the invention the part close to the tangential inlet (1) for mixture M1. According to this embodiment, the apparatus comprises a for example helical roof (10) descending from the extreme level of the tangential input (1). Said means (10) may likewise consist of an inner or outer spiral. Said means furthermore make it possible to limit interference between the flow or mixture M1 and the flows of the phases already present in the separator and likewise to limit turbulences at the level of the tangential inlet (1). Usually, particularly in the case of a descending helical roof, the pitch of the helix is approx. 0.01 to approx. 3 times the value of (Lk) and more often than not approx. 0.5 to approx. 1.5 times this value.

In this preferred embodiment of the invention, the apparatus likewise comprises between the outer and inner inlets means of stabilising the helical flow of at least the light phase L1 and of limiting the volume which can be used for separation. These means are preferably centred on the axis of the inner enclosure.

Said means may be a cone the tip of which is directed towards the inner inlet while the base of which is situated at the extreme level of the tangential inlet (1). They may also be formed, as is shown diagrammatically in FIG. 5, by a cylinder (11) extended by a cone (12). The diameter of the base of the cone is identical to that of the cylinder and is strictly less than the diameter (Dc). This diameter is usually approx. 0.01 to approx. 1.5 times the diameter (Di) of the inner inlet (3) and preferably approx. 0.75 to approx. 1.25 times the diameter (DI). The axial bulk or dimension between the extreme level of these means closest to the tangential inlet and the opposite end of the said means is usually approx. 0.01 to approx. 3 times the value (Ls) of the distance between the extreme level of the tangential inlet (1) and a level of the inner inlet (3) and preferably approx. 0.75 to approx. 1.25 times this value (Ls).

The funnel means (7) through which the dense phase D1 emerges normally make it possible to collect and channel this dense phase D1 as far as the outer outlet (9). Said means are more often than not an inclined bottom or a cone the axis of which may or may not be on the inner outlet (4).

The apparatuses according to the present invention thus allow rapid separation from a mixture M1 comprising a dense phase and a light phase of the said dense phase and the said light phase. They may advantageously be used in the case where the mixture to be separated is a mixture obtained at the issue from a chemical reaction and comprising at least one phase which contributes to this reaction.

In the present description the phases are, with regard to the light phases, liquid or gaseous phases or phases which contain both liquid and gas, while where the dense phase is concerned this may be a solid phase (in the form of particles), a liquid phase or a phase containing both a solid and a liquid. Two cases are frequently encountered: the first case in which the dense phase is a solid phase while the light phases are gases and the second case in which there is a liquid phase which may be the dense phase or the light phase.

The diameter (Dc) of the apparatus measured at the level of the tangential inlet (1) on the side of its end which is closest to the inner inlet (3) is normally approx. 0.01 to approx. 10 m (meters) and more often than not approx. 0.05 to approx. 2 m. It is usually preferable to preserve a constant diameter over the entire length of the apparatus comprised between the end of the tangential inlet which is closest to the inner inlet (3) and the said inner inlet (3) or even from the level of injection of the mixture M1 as far as the level of the funnel means (7) through which the dense phase D1 emerges; however, it will not be going beyond the scope of the invention in the case of an apparatus comprising enlargements or narrowings of cross-section between the said levels.

To achieve a good separation of a phase L1 contained in the mixture M1 comprising likewise at least one phase D1 it is preferable to have a superficial inlet speed of this phase L1 which is high and which is for example approx. 5 to approx. 150 $mxs^{-1}$ (meters per second) and preferably approx. 10 to approx. 75 $mxs^{-1}$. The ratio by weight of the rate of flow of the phase D1 to the rate of flow of the phase L1 is usually approx. 0.0001:1 to approx. 50:1 and is most frequently approx. 0.1:1 to approx. 15:1.

By increasing the difference in pressure between the inlet (3) and the funnel means (7) which may be achieved for example by increasing the pressure downstream, in the direction of circulation of the dense phase D1, of the inner inlet (3) or by reducing the pressure downstream (in the direction of travel of the dense phase D1, of the funnel means (7) through which this phase emerges, it is possible to extract a more or less considerable part of the phase L1 with the phase D1 and simultaneously obtain the level of the outlet (4) a mixture which is virtually completely free of phase D1. It is thus possible to draw off up to 90% of the phase L1 with D1 but more often than not one will draw off approx. 1 to approx. 10% of this phase L1 with the phase D1. Fluctuations in pressure which make it possible to affect the quantity of phase (1) drawn off with the phase D1 are provided by means well known to a man skilled in the art and for example by altering the rate of flow of phase L3 or by altering the working conditions downstream of the outlet (9). Thus, in an advantageous embodiment of the invention, the apparatus will comprise at least one means permitting the drawing off through the outer outlet (5) of at least a part of the light phase L1 in mixture with the dense phase D1.

In various apparatuses according to the invention and in the various methods of injection of the mixture M1 such a drawing off may make it possible to improve the efficiency of recovery of the dense phase D1.

The choice between an apparatus comprising a tangential inlet for the mixture M1 and an apparatus comprising an axial inlet for the mixture M1 is usually guided by the ratio by weight of the rate of flow of the phases L1 and D1. In the event of this ratio being less than 2:1 it may be advantageous to choose an apparatus with an axial inlet.

Noted in the prior air is U.S. Pat. No. 4,746,340 which relates to an air purifier and not an apparatus for the separation of two (light and heavy) phases of a solid/gas mixture obtained particularly after a chemical reaction. Also noted is U.S. Pat. No. 3,955, 948 which differs from the invention by the use of helical valves instead of flat blades.

The example which follows is given by way of illustration and shows the efficiency of separation of a light (gaseous) phase L1 contained in a mixture M1 also containing a dense (solid) phase D1 and also the efficiency of the blades in the penetration of the vortex of the gaseous phase L1 into the outer outlet.

EXAMPLE

Two apparatuses of vertical axes in accordance with those shown diagrammatically in FIGS. 1A and 2 are provided, which comprise a tangential descending roof-type inlet over ¾ turns continuously over a height equal to the value of Lk. These apparatuses have the geometrical characteristics shown in Table I hereafter. They comprise a dead space in the form of that shown diagrammatically in FIG. 5 and composed of a cylinder extended by a cone the tip of which is directed towards the inner inlet (3). The diameter of the cylinder is equal to 0.5 times the diameter (Dc) of the outer enclosure, its height is 0.5×(Dc) and the cone has a circular base of diameter 0.5×(Dc) and a height of 1×(Dc).

TABLE I

| Dimensions in cm | Apparatus A with blades | Apparatus B without blades |
|---|---|---|
| Dc | 5.1 | 5.1 |
| De | 2.5 | 2.5 |
| Ls | 7.6 | 7.6 |
| Lk | 2.5 | 2.5 |
| Lp | 2.5 | — |
| hpe | 5.1 | — |
| hpi | 5.1 | — |
| hk | 1.3 | 1.3 |
| ep | 1.2 | — |
| Np* (number) | 8 | 0 |
| p' | 25 | 25 |

*Np represents the number of blades. The other symbols are defined in the description.

The flows of the phases introduced are characterised by means of the following notations:

Inlet temperature: T
Mass rate of flow: F
Volumetric rate of flow: Q
Volumetric mass: R
Superficial speed: V
Particle skip diameter: ds The phase L1 is of the air and has the following characteristics:

$TL1=25°$ C., $FL1=7.4\times10^{-3}$ Kg/s, $QL1=6.2\times10^{-3}$ $m^3/s$, $VL1=V=18$ m/s There is no injection of phase L2.

The phase D1 consists of glass b all having the following characteristics:

TD'=25° C., FD1=$14\times10^{-3}$ Kg/s, RD1=2500 Kg/m$^3$, dsD1=$29\times10^{-6}$ m.

The performance levels of the apparatuses mentioned in Table II are expressed as follows:

ED'=efficiency of separation of D1 in the apparatus (ratio of the mass rate of flow of D1 measured in the pipe (9) for the recovery of the dense phase D1 to the mass rate of flow of D1 introduced into the tangential inlet (1)) with an extraction of the phase L1 in the pipe (9) for recovery of the dense phase D1 of 2% by weight in relation to the weight of L1 introduced into the tangential inlet (1).

Pvortex=distance between the end of the vortex of L1 in the outer outlet (5) and the apex of the inner inlet (3). This distance is measured by means of thermal sensors which make it possible to show the disappearance of the tangential speed component and therefore of the vortex in the flow of phase L1 into the outer outlet (5).

TABLE II

| Performance | Apparatus A | Apparatus B |
|---|---|---|
| ED1 | 99.9% | 99.9% |
| Pvortex | 4 cm | 18 cm |

We claim:

1. A co-current cyclone separator comprising in combination:

a) an outer enclosure having a cylindrical wall about an axis, the outer enclosure having a first end with a top wall and a second end spaced from the top wall by a distance (L);

b) an outer enclosure inlet at the first end, the inlet having a top wall proximate the top wall of the outer enclosure and extending in a direction perpendicular, but radially spaced, with respect to the axis of the outer enclosure for introducing a mixture M1 containing at least one dense phase D1 and a light phase L1 tangentially into the outer enclosure;

c) means for recovering the dense phase D1 positioned at the second end of the outer enclosure;

d) an outer enclosure outlet downstream of the recovering means proximate second end of the outer enclosure;

e) an inner enclosure of a circular cross section disposed coaxially within the outer enclosure to define an annular space therebetween; the inner enclosure having first and second ends;

f) an inner enclosure inlet axially spaced from the outer enclosure inlet by a distance LC;

g) an inner enclosure outlet positioned exteriorly with respect to the outer enclosure;

h) a plurality of spaced, axially extending blades disposed in the annular space between the inner and outer enclosures, the blades being planar and also extending radially with respect to the axis of the outer enclosure; the spaced blades providing means for limiting accumulation of the light phase proximate the circular wall of the outer enclosure; and i) means disposed in the outer enclosure between the inner enclosure inlet and the second end of the outer enclosure for introducing additional light phase fluid L2 into the outer enclosure whereby at least a substantial portion of the dense phase D1 is separated from the mixture M1 and exits from the outer enclosure outlet.

2. A cyclone separator according to claim 1 in which the outer enclosure is substantially vertical while the means limiting progress of the light phase L1 to the exterior of the inner enclosure are positioned inside the outer enclosure and on the outside of the inner enclosure, between the level of the inner inlet and the means of recovery of the dense phase D1.

3. A cyclone separator according to claim 1 in which the outer enclosure is substantially horizontal and the means limiting progression of the light phase L1 to the outside of the inner enclosure are positioned downstream in the direction of travel of the dense phase D1 of the means of recovering the dense phase D1 in the pipe of the outer outlet.

4. A cyclone separator according to claim 1 comprising at least one means permitting, via the outer outlet, the drawing off of at least a part of the light phase L1 in mixture with the dense phase D1.

5. A cyclone separator according to claim 1 comprising 2 to 50 blades each having a dimension (ep) measured horizontally from its edge closest to the axis of the outer enclosure of approx. 0.01 to approx. 1 times the value when these blades are, in the case of a vertical cyclone separator, positioned between the outer wall of the inner enclosure of outside diameter (D'e) and the inner wall of the outer enclosure of inside diameter (Dc) of approx. 0.01 to approx. 1 times the value (Dc)/2 in the case of a vertical cyclone separator with a lateral inner outlet when they are [((Dc)−(D'e))/2] positioned after this inner outlet and approx. 0.01 to 1 times the diameter (Ds) of the outer outlet pipe in the case of a horizontal cyclone separator, a dimension (hpe) measured in the direction parallel with the substantially vertical axis through which passes the plane of the blade, on the edge of the blade closest to the inside wall of the outer enclosure or of the inner wall of the outer outlet and a dimension (hpi) measured on the edge of the blade closest to the axis of the inner enclosure or the axis of the outer outlet in the direction parallel with the substantially vertical axis through which the plane of the blade passes, the said dimension (hpe) and (hpi) being approx. 0.1×(Dc) to approx. 10×(Dc) the said blades each being situated at a distance in relation to the inner input in the case of a vertical cyclone separator or in relation to the separation means in the case of a horizontal cyclone separator, or approx. 0 to approx. 5×(Dc).

6. A cyclone separator according to claim 5 in which the blades each have a dimension (hpi) which is greater than or equal to (hpe).

7. A cyclone separator according to claim 1 comprising between the outer inlet and the inner inlet means of stabilising the helical flow of at least the light phase L1 and of limiting the volume which can be used for separation.

8. A cyclone separator according to claim 1 comprising means of limiting interference between the flow of mixture M1 introduced and the flows of the phases already present in the separator, chosen from the group consisting of a descending roof, an outer spiral and an inner spiral.

9. The co-current cyclone separator of claim 1 wherein the means for recovering the dense phase includes a surface extending in a direction transverse to the axis of the outer enclosure, the surface intercepting the dense phase D1 and directing the dense phase toward the outer enclosure outlet.

* * * * *